US010165352B2

(12) United States Patent
Cartwright et al.

(10) Patent No.: US 10,165,352 B2
(45) **Date of Patent: *Dec. 25, 2018**

(54) AMBIENT SONIC LOW-PRESSURE EQUALIZATION

(71) Applicant: WESTONE LABORATORIES, INC., Colorado Springs, CO (US)

(72) Inventors: Karl Cartwright, Colorado Springs, CO (US); Kris Cartwright, Colorado Springs, CO (US)

(73) Assignee: WESTONE LABORATORIES, INC., Colorado Springs, CO (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/590,437

(22) Filed: May 9, 2017

(65) Prior Publication Data

US 2017/0245044 A1 Aug. 24, 2017

Related U.S. Application Data

(63) Continuation-in-part of application No. 15/378,288, filed on Dec. 14, 2016.

(60) Provisional application No. 62/267,705, filed on Dec. 15, 2015.

(51) Int. Cl.

| | |
|---|---|
| ***H04R 1/10*** | (2006.01) |
| ***H04R 1/28*** | (2006.01) |
| *H04R 1/26* | (2006.01) |

(52) U.S. Cl.

CPC ..... *H04R 1/1075* (2013.01); *H04R 1/1016* (2013.01); *H04R 1/2811* (2013.01); *H04R 1/26* (2013.01); *H04R 1/2842* (2013.01); *H04R 2460/11* (2013.01)

(58) Field of Classification Search

CPC .. H04R 25/652; H04R 25/656; H04R 1/1016; H04R 2225/023; H04R 2460/11; H04R 2460/17; H04R 25/658; H04R 1/1058; H04R 25/554; H04R 25/604

USPC ..... 381/380, 328, 71.6, 330, 72, 309

See application file for complete search history.

(56) References Cited

U.S. PATENT DOCUMENTS

| | | | | |
|---|---|---|---|---|
| 2004/0234089 | A1* | 11/2004 | Rembrand | H04R 25/30 381/312 |
| 2006/0133631 | A1* | 6/2006 | Harvey | H04R 1/1016 381/312 |
| 2007/0121974 | A1* | 5/2007 | Nemirovski | H04R 1/1016 381/312 |
| 2008/0260180 | A1* | 10/2008 | Goldstein | H04R 25/50 381/110 |

(Continued)

OTHER PUBLICATIONS

DK8600113 Rise-R-536 Calculations for Piezoelectric Ultrasonic Transducer by Henrik Jensen Rise National Laboratory, DK-4000 Roskilde, Denmark, May 1986.*

*Primary Examiner* — Matthew Eason
*Assistant Examiner* — Julie X Dang
(74) *Attorney, Agent, or Firm* — Martensen IP

(57) ABSTRACT

A passive ambient in-ear monitor includes an interchangeable unidirectional sonic filter that allows ambient sound to pass through to the ear canal and be combined with sound generated by internal drivers. A sonic low pressure equalization device of a predetermined spatial volume links the sonic filter with the internal drivers to deliver to the user a mixture of generated and ambient sound without any substantial degradation to low frequency sound.

25 Claims, 14 Drawing Sheets

(56) References Cited

U.S. PATENT DOCUMENTS

2010/0296667 A1* 11/2010 Parkins ..... H04M 1/05
381/74
2012/0181997 A1* 7/2012 Jonsson ..... H02M 7/53803
323/271
2013/0056295 A1* 3/2013 Campbell ..... H04R 25/652
181/135
2015/0065813 A1* 3/2015 Wochlik ..... A61B 5/04845
600/301
2015/0098581 A1* 4/2015 Harvey ..... H04R 1/1016
381/74
2015/0172814 A1* 6/2015 Usher ..... H04R 3/005
381/92
2015/0289061 A1* 10/2015 Rasmussen ..... H04R 25/02
381/329
2016/0100260 A1* 4/2016 Ruppersberg ..... H04R 25/453
381/326

* cited by examiner

AMBIENT SONIC LOW-PRESSURE EQUALIZATION

RELATED APPLICATION

The present application relates to and is a continuation-in-part of U.S. patent application Ser. No. 15/378,288 filed 14 Dec. 2016 which claims the benefit of priority to U.S. Provisional Patent Application No. 62/267,705 filed 15 Dec. 2015 which is hereby incorporated by reference in its entirety for all purposes as if fully set forth herein.

BACKGROUND OF THE INVENTION

Field of the Invention

Embodiments of the present invention relate, in general, to introduction of ambient sounds into ear pieces (ear phones or in-ear monitors) and more particularly to ambient equalization (particularly of low frequencies) of sonic ear pieces.

Relevant Background

Musicians, performers and the like need to hear themselves and other members of a band or performers in order to stay in-time and/or in-tune. To do so they use a methodology called monitoring. Historically open speakers called floor wedges have been used to provide a combined mix of the performers voices, instruments and/or music tracks in order for the performers to hear other pertinent audio during the performance.

Some years ago, legacy hearing aid style in-ear custom molded monitors were introduced into the market. These custom in-ear monitors took the place of the floor wedges. The custom in-ear monitors substantially reduced the amount of equipment needed for the performers, lowered overall stage volume and reduced risk of hearing damage from performers by allowing the overall monitoring level to be lower.

In-ear monitors are quite small and are normally worn just outside and in the ear canal. As a result, the acoustic design of the monitor must lend itself to a very compact design utilizing small components. Some monitors are custom fit (i.e., custom molded) while others use a generic "one-size-fits-all" earpiece. Generic earpieces may include a removable and replaceable ear-tip sleeve that provides a limited degree of customization.

In-ear monitors, also referred to as canal phones and stereo earphones, are also commonly used to listen to both recorded and live music. A typical recorded music application would involve plugging the monitor into a music player such as a CD player, flash or hard drive based MP3 player, home stereo, or similar device using the device's headphone socket. Alternately, the monitor can be wirelessly coupled to the music player. In a typical live music application, an on-stage musician wears the monitor in order to hear his or her own music during a performance. In this case, the monitor is either plugged into a wireless belt pack receiver or directly connected to an audio distribution device such as a mixer or a headphone amplifier. This type of monitor offers numerous advantages over the use of stage loudspeakers, including improved gain-before-feedback, minimization/elimination of room/stage acoustic effects, cleaner mix through the minimization of stage noise, and increased mobility for the musician.

In-ear monitors face a common problem, isolation. In-ear monitor isolation is the reduction in ambient volume caused by the sound isolation the in-ear monitor provides. To hear the audience, some performers remove one earpiece or have to crank up an ambient mic channel to still enjoying the benefits of the isolation that in-ear monitors brings. For many artists, engagement with the audience is important. Yet is it often very difficult to engage with an audience when both ears are plugged. One solution to this problem is to use an in-ear monitor in only one ear. However, when this solution is used, to hear all of the mix in the one ear that is utilizing an in-ear monitor, the volume can be dangerously loud and may injure the wearer. Another solution as known in the prior art and by many in-ear monitor companies is an option called "ambient ports." Unfortunately, the use of an ambient port results in a substantial reduction in the bass/low frequency response.

Accordingly, there is a need to provide in-ear monitors, ear pieces and ear phones that can provide ambient sound without substantial reduction in low frequency fidelity.

Additional advantages and novel features of this invention shall be set forth in part in the description that follows, and in part will become apparent to those skilled in the art upon examination of the following specification or may be learned by the practice of the invention. The advantages of the invention may be realized and attained by means of the instrumentalities, combinations, compositions, and methods particularly pointed out in the appended claims.

SUMMARY OF THE INVENTION

The present invention combines ambient sound with that generated by internal sound drivers in an in-ear monitor without any substantial degradation of low frequency performance. According to one embodiment of the invention a passive ambient in-ear monitor includes a housing coupled to an ear canal stalk. The housing is further associated with a filter, such that the filter includes an outer face and an inner face. Ambient sound waves from the surrounding environment traverse the filter from the outer face to the inner face. The in-ear monitor further includes one or more sound drivers wherein sound drivers produce internal sound waves. The internal sound waves are combined with the ambient sound waves by a Sonic Low-pressure Equalization Device ("SLED") that is coupled to each of the one or more sound drivers, the ear canal stalk and the filter. The SLED can be an integrated component of the ear canal stalk and/or the housing or a separate device. The SLED includes a predetermined spatial volume channeling internal sound waves and ambient sound waves to the ear canal stalk such that a measure of frequency response of the internal sound waves at the ear canal stalk is within a frequency response predetermined range. This predetermined range preserves low frequency performance.

The ear canal stalk of the passive ambient in-ear monitor described above includes an ear tip that fully occludes the ear canal. In addition, the sonic filter is a unidirectional sonic filter that substantially reduces any internal sound waves traversing from the inner face to the outer face. The unidirectional sonic filter also attenuates ambient sound waves traversing from the outer face to the inner face. The attenuation of sound can vary but in one embodiment attenuation is between 0 and 10 dB while in another embodiment attenuation is between 10 and 25dB. In other embodiments the filter can be fully occluded converting the passive ambient in-ear monitor to a fully occluded monitor.

The frequency response predetermined range of the passive ambient in-ear monitor described above is, in one embodiment, ±4dB of the internal sound waves over 20-20000 Hz while in a different embodiment, the frequency response predetermined range of the internal sound waves at the ear canal stalk over 20-2000 Hz is ±4dB.

The invention presented herein also includes methodology for providing passive ambient sound in an in-ear monitor. Such methodology includes configuring the in-ear monitor to fully occlude an ear canal. The in-ear monitor, in this instance, includes an ear canal stalk, one or more drivers, a filter and a Sonic Low-pressure Equalization Device. The method continues by interposing the SLED between each of the one or more sound drivers, the ear canal stalk and the filter. Thereafter ambient sound waves from the filter and internal sound waves from the one or more drivers are received by the SLED. These combined sound waves are channeled by the SLED through a predetermined spatial volume to the ear canal stalk such that a measure of frequency response of internal sound waves generated by the one or more drivers at the ear canal stalk is within a frequency response predetermined range.

The methodology described above can substantially reduce internal sound waves from traversing the filter. Moreover, the filter attenuates, in some embodiments, ambient sound waves entering the in-ear monitor by 0-10 dB and/or 10-25 dB. And while attenuating ambient sound, the frequency response predetermined range of internal sound wave can be limited to ±4 dB. In one embodiment, the frequency response predetermined range of internal sound waves at the ear canal stalk for 20-20000 Hz is limited to ±4 dB, while in another embodiment the frequency response predetermined range of internal sound waves at the ear canal stalk for 20-2000 Hz is limited to ±4 dB. And in yet another embodiment the frequency response predetermined range of internal sound waves at the ear canal stalk for 20-200 Hz is limited to ±4 dB.

The features and advantages described in this disclosure and in the following detailed description are not all-inclusive. Many additional features and advantages will be apparent to one of ordinary skill in the relevant art in view of the drawings, specification, and claims hereof. Moreover, it should be noted that the language used in the specification has been principally selected for readability and instructional purposes and may not have been selected to delineate or circumscribe the inventive subject matter; reference to the claims is necessary to determine such inventive subject matter.

BRIEF DESCRIPTION OF THE DRAWINGS

The features and objects of the present invention and the manner of attaining them will become more apparent, and the invention itself will be best understood, by reference to the following description of one or more embodiments taken in conjunction with the accompanying drawings, wherein:

FIG. 8 and FIG. 9 show plots of frequency response of a passive ambient in-ear monitor, according to one or more embodiments of the present invention, from approximately 20-20000 Hz wherein FIG. 8 presents a comparison of a passive ambient in-ear monitor using a unidirectional sonic filter with an ambient sound channel of the present invention and in-ear monitor with an open-air vent (or a bidirectional sonic filter);

FIG. 9 presents a comparison of a passive ambient triple driver in-ear monitor with a unidirectional filter and an ambient sound channel of the present invention as compared to a passive ambient triple driver in-ear monitor with a unidirectional filter but lacking a dedicated ambient sound channel.

Figure 1A:
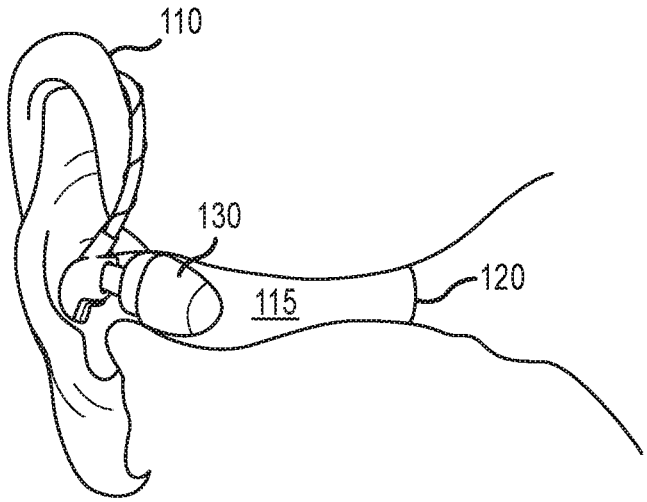
FIG. 1A provides a side cutaway view of an in-ear monitor according to one embodiment of the present invention, occupying the ear canal of a user.

The Figures depict embodiments of the present invention for purposes of illustration only. One skilled in the art will readily recognize from the following discussion that alternative embodiments of the structures and methods illustrated herein may be employed without departing from the principles of the invention described herein.

DESCRIPTION OF THE INVENTION

One or more embodiments of the present invention enables a user to hear both the signal (i.e. music, speech, etc.) coming from the source device (i.e. radio, audio player and other like devices) driving the speakers in the earpiece or monitor to be heard in the user's ear and nearby ambient sound without any significant loss to the low frequency spectrum. According to one embodiment of the present invention an ambient filtered vent allows sound to pass through to the ear canal from the outside world, for example, the sound of a live stage, traffic noise, speech, warning sirens and indicators. This passage of ambient sound is accomplished with no degradation or reduction of the low frequency response of sound generated by the internal drivers.

The loss of low frequency output is a common problem with insert earphones or in-ear monitors as the volume of air moved by these small speakers is dependent on the total mass of air the speaker has to move. This is particularly evident in low frequency response. In one embodiment of the present invention, the retention of low frequency energy is accomplished by incorporating into the in-ear monitor a filter comprising a membrane that has a limited amount of resistive effect on the air in an ambient channel that prevents air (and sonic wave forms) from exiting the sound channel. In addition, the sound from the internal speakers, or drivers as they are also referred to herein, and the ambient vent are very carefully controlled via an acoustic sound path that allows the signal source from the speakers to arrive at the ear canal unimpeded, while the ambient sound arrives at the ear only reduced by the reduction provided by the attenuating filter. Lastly, the specific amount or volume of air in the ambient vent (channel) and acoustic sound path is very closely controlled via volume, dimensional length and diameter specifications. These combinations enable an in-ear monitor to deliver high fidelity sound reproduction with minimal loss of low frequency output from the drivers/speakers while simultaneously supplying ambient sound of the surrounding environment with minimal loss of low frequency response.

Embodiments of the present invention are hereafter described in detail with reference to the accompanying Figures. Although the invention is hereafter described and illustrated with a certain degree of particularity, it is understood that the present disclosure has been made only by way of example and that numerous changes in the combination and arrangement of parts can be resorted to by those skilled in the art without departing from the spirit and scope of the invention.

The following description with reference to the accompanying drawings is provided to assist in a comprehensive understanding of exemplary embodiments of the present invention as defined by the claims and their equivalents. It includes various specific details to assist in that understanding but these are to be regarded as merely exemplary. Accordingly, those of ordinary skill in the art will recognize that various changes and modifications of the embodiments described herein can be made without departing from the scope and spirit of the invention. Also, descriptions of well-known functions and constructions are omitted for clarity and conciseness.

The terms and words used in the following description and claims are not limited to the bibliographical meanings, but, are merely used by the inventor to enable a clear and consistent understanding of the invention. Accordingly, it should be apparent to those skilled in the art that the following description of exemplary embodiments of the present invention are provided for illustration purpose only and not for the purpose of limiting the invention as defined by the appended claims and their equivalents.

By the term "substantially" it is meant that the recited characteristic, parameter, or value need not be achieved exactly, but that deviations or variations, including for example, tolerances, measurement error, measurement accuracy limitations and other factors known to those of skill in the art, may occur in amounts that do not preclude the effect and the characteristic was intended to provide.

An "in-ear monitor" is a device in which a portion occupies the entirety of the outer portion of the ear canal so as to occlude transmission of ambient (surrounding) sounds to the ear drum. For the purpose of the present invention an in-ear monitor is synonymous with canal phones, ear pieces and stereo earphones.

"Frequency Response" is the quantitative measure of the output spectrum of a system or device in response to a stimulus, and is used to characterize the dynamics of the system. It is a measure of magnitude and phase of the output as a function of frequency, in comparison to the input. For an audio system, the objective is to reproduce the input signal at a certain amplitude with no distortion. That would require a uniform (flat) magnitude of response up to the bandwidth limitation of the system. In the context of the present invention a frequency response is a measure of a loss of amplitude and/or source of distortion of signals generated by an in-ear monitor speaker/driver. For example frequency response of 4 dB indicates a loss of 4 dB as compared to the originally generated signal.

"Occluded" is, for the purposes of this invention, to mean to close up or block off, obstruct. With respect to an in-ear monitor the device fully blocks or obstructs the ear canal such that only sound either generated within the in-ear monitor or sound allowed to traverse through the in-ear monitor is delivered to the ear canal and ultimately to the ear drum.

Like numbers refer to like elements throughout. In the figures, the sizes of certain lines, layers, components, elements or features may be exaggerated for clarity.

The terminology used herein is for the purpose of describing particular embodiments only and is not intended to be limiting of the invention. As used herein, the singular forms "a," "an" and "the" are intended to include the plural forms as well, unless the context clearly indicates otherwise. Thus, for example, reference to "a component surface" includes reference to one or more of such surfaces.

As used herein any reference to "one embodiment" or "an embodiment" means that a particular element, feature, structure, or characteristic described in connection with the embodiment is included in at least one embodiment. The appearances of the phrase "in one embodiment" in various places in the specification are not necessarily all referring to the same embodiment.

As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but may include other elements not expressly listed or inherent to such process, method, article, or apparatus. Further, unless expressly stated to the contrary, "or" refers to an inclusive or and not to an exclusive or. For example, a condition A or B is satisfied by any one of the following: A is true (or present) and B is false (or not present), A is false (or not present) and B is true (or present), and both A and B are true (or present).

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the specification and relevant art and should not be interpreted in an idealized or overly formal sense unless expressly so defined herein. Well-known functions or constructions may not be described in detail for brevity and/or clarity.

It will be also understood that when an element is referred to as being "on," "attached" to, "connected" to, "coupled" with, "contacting", "mounted" etc., another element, it can be directly on, attached to, connected to, coupled with or contacting the other element or intervening elements may also be present. In contrast, when an element is referred to as being, for example, "directly on," "directly attached" to, "directly connected" to, "directly coupled" with or "directly contacting" another element, there are no intervening elements present. It will also be appreciated by those of skill in the art that references to a structure or feature that is disposed "adjacent" another feature may have portions that overlap or underlie the adjacent feature.

Spatially relative terms, such as "under," "below," "lower," "over," "upper" and the like, may be used herein for ease of description to describe one element or feature's relationship to another element(s) or feature(s) as illustrated in the figures. It will be understood that the spatially relative terms are intended to encompass different orientations of a device in use or operation in addition to the orientation depicted in the figures. For example, if a device in the figures is inverted, elements described as "under" or "beneath" other elements or features would then be oriented "over" the other elements or features. Thus, the exemplary term "under" can encompass both an orientation of "over" and "under". The device may be otherwise oriented (rotated 90 degrees or at other orientations) and the spatially relative descriptors used herein interpreted accordingly. Similarly, the terms "upwardly," "downwardly," "vertical," "horizontal" and the like are used herein for the purpose of explanation only unless specifically indicated otherwise.

Figure 1B:
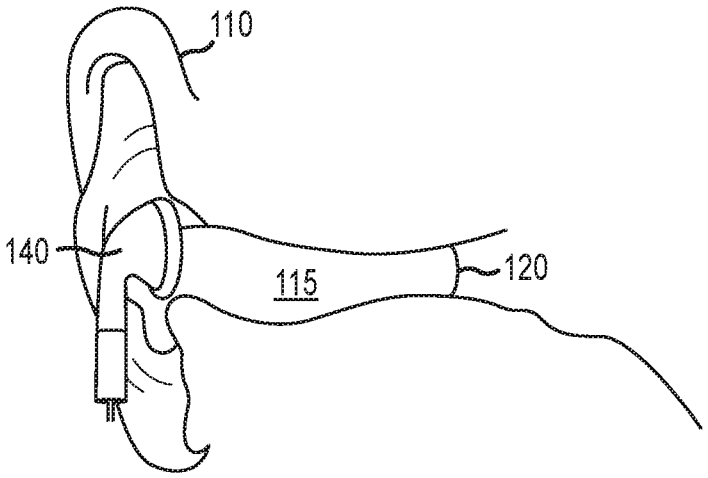
FIG. 1B provides a comparison of fully occluded and non-occluding earphones and in-ear monitors as would be known in the prior art.

FIG. 1A provides a side cutaway view of an in-ear monitor according to one embodiment of the present invention, occupying the ear canal of a user. In the embodiment of the present invention shown in FIG. 1A a housing encompasses one or more drivers (speakers) that connect with a Sonic Low-pressure Equalization Device (hereafter "SLED") that channels the sound produced by these internal speakers (internal sound) to the ear canal stalk positioned within the ear channel 115. The ear canal stalk is encased by, in this embodiment, an expansive ear tip 130. The ear tip, upon compression and insertion into the ear canal, expands so as to occupy the lateral confines of the ear canal 115. By doing so the in-ear monitor occludes the ear canal and substantially blocks ambient sounds outside of the ear from entering the ear canal and reaching the ear drum 120. By comparison, the ear bud 140 shown in FIG. 1B resides outside the ear canal 115. Sound generated by the ear bud 140 is combined with ambient sounds that "leak" into the ear canal due to the ear bud's imperfect seal. This requires the wearer to turn the volume of the internal speaker up in amplitude so that it can compete with external sound sources, defeating one of the advantages that in-ear monitors can provide. Similarly, certain sounds generated by the ear bud leak through the same imperfect seals and fail to reach the ear canal 115 or ear drum 120. Low frequency sounds are extremely susceptive to such leaks resulting in external ear bud low frequency performance generally lacking that of in-ear monitors, and the like, in which the ear canal is occluded.

Positioned on the exterior portion of the in-ear monitor of the present invention and coupled with the housing is a unidirectional sonic filter which attenuates ambient sound. A predetermined diminished amplitude of ambient sound is determined by the degree of attenuation of the ambient sound waves by the unidirectional sonic filter. The sonic filter is also coupled to the SLED via a predetermined spatial volume or channel that combines attenuated ambient sound with the internal sound generated by the one or more drivers. These combined sound waves are thereafter delivered to the ear canal stalk and ultimately to the ear drum. In another embodiment of the present invention the unidirectional sonic filter can be selectively fully occluded. A selectively fully occluded sonic filter converts passive ambient in-ear monitor of the present invention to a fully occluded in-ear monitor. By doing so users can selectively determine whether to include ambient sounds or to simply focus on sound generated by the drivers.

Figure 2:
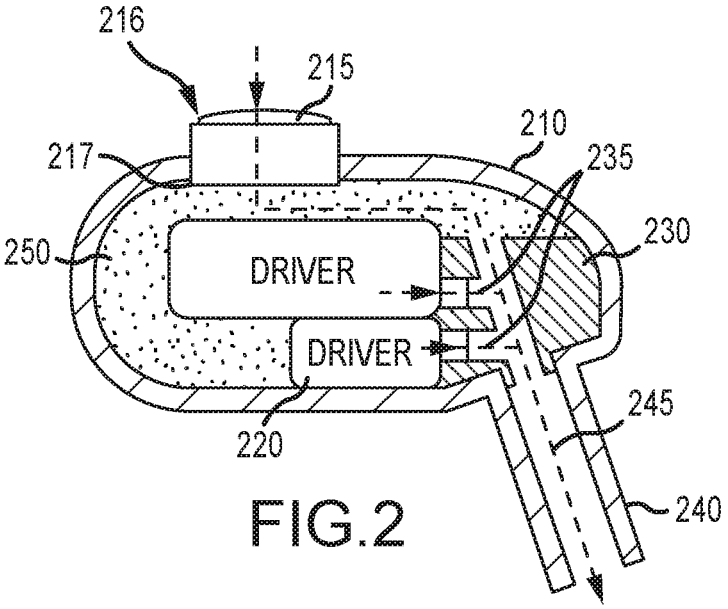
FIG. 2 provides a side cutaway view of a passive ambient in-ear monitor according to one embodiment of the present invention.

FIG. 2 provides a side cutaway view of a passive ambient in-ear monitor according to one embodiment of the present invention. A housing 210 encompasses, in this embodiment, a pair of speaker drivers 220. In other embodiments, the number of drivers 220 encased by the housing 210 may be one or more of a plurality of drivers. Each driver shown in FIG. 2 couples to the SLED 230. As shown in this cutaway the SLED includes internal driver channels 235 that combine the internal sound waves generated by each of the drivers 220 into a common channel 245. As shown the common channel 245 and internal driver 235 channels meet at an obtuse angle. The angle facilitates reflection of the internal sound waves toward the ear canal stalk 240. When a longitudinal sound wave, such as those waves exiting the drivers, strikes a flat surface, sound is reflected in a coherent manner provided that the dimension of the reflective surface is large compared to the wavelength of the sound. Note that audible sound has a very wide frequency range (from 20 to about 20000 Hz), and thus a very wide range of wavelengths (from about 20 mm to 20 m). As a result, the overall nature of the reflection varies according to the texture and structure of the surface. For example, porous materials will absorb some sound energy, and rough materials (where rough is relative to the wavelength) tend to reflect it in many directions—to scatter the energy, rather than to reflect it coherently.

The present invention uses a conical smooth surface relative to the wavelength to promote reflection of the internal sound waves toward the ear canal stalk 240. In a different embodiment, the channels are rectangular providing a flat reflective surface. The common channel 245 is, with respect to each internal driver channel 235, oriented at a predetermined obtuse angle. These angles are based upon anatomical considerations to get the earpiece to fit in the ear canal. One of ordinary skill in the relevant art will appreciate the configuration and orientation of the SLED's internal channels may vary so as to optimize transmission of sound from the drivers to the ear canal stalk and ultimately to the ear drum of a user.

The in-ear monitor of FIG. 2 further shows an upper port of the SLED common channel that opens into the interior space 250 of the in-ear monitor housing 210. Incorporated into the housing and substantially opposing the ear canal stalk is a unidirectional sonic filter 215 having an inner face 217 and an outer face 216. The unidirectional sonic filter allows ambient sound waves to traverse the filter from the surrounding environment into the interior spatial volume of the in-ear monitor. As ambient sound waves enter the interior spatial volume 250 they are redirected to the opening of the common channel 245 by the interior surfaces of the housing. The spatial interior volume 250 is fixed with the only outlet for the sound waves being the common channel 245. The unidirectional filter 215 substantially blocks any internally reflected sound waves from exiting the housing 210.

Figure 3:
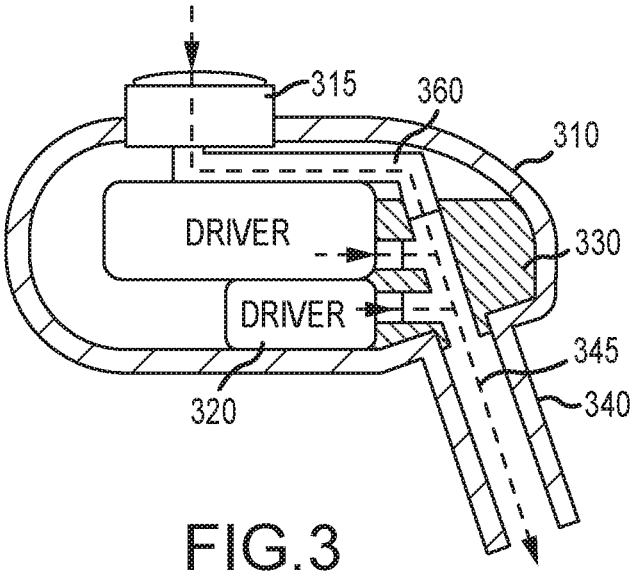
FIG. 3 is a side cutaway view of another embodiment of a passive ambient in-ear monitor according to one embodiment of the present invention.

FIG. 3 is a side cutaway view of another embodiment of a passive ambient in-ear monitor according to one embodiment of the present invention. As with the embodiment shown in FIG. 2, this embodiment includes two speaker drivers 320 that direct internal sound waves through internal driver channels toward a common channel 345. The waves are reflected toward the ear canal stalk 340 based on the shape and conditions of the surface opposite the internal driver channels. Again, the housing incorporates a unidirectional sonic filter 315 that allows attenuated ambient sound waves to traverse the filter and enter into the interior portion of the in-ear monitor. Unlike the embodiment shown in FIG. 2, the present embodiment includes an ambient sound channel 360 coupling the unidirectional sonic filter 315 on the upper portion of the common channel 345. As with the internal driver channels, the ambient sound channel 360 joins the common channel at an angle so as to promote reflection of the ambient sounds waves toward the ear canal stalk 340.

The spatial volume of the ambient sound channel 360 is based on a desired frequency response predetermined range. By controlling the volume and pressure through which reflected sound waves travel the internal sound wave frequency response can be optimized.

The unidirectional nature of the ambient sound filter inhibits low frequency sound waves from exiting the in-ear monitor. While bidirectional ambient vents or ports can introduce ambient sound to the in-ear monitor, the trade off with such inclusion is poor frequency response particularly at low frequencies. The present invention resolves this failing by providing to a user sounds reflective of the surrounding environment without sacrificing the frequency response of the sound drivers internal to the in-ear monitor.

The embodiments depicted in FIGS. 2 and 3 represents generic, one size fits all, type of in-ear monitors. In each case, the in-ear monitors shown in FIGS. 2 and 3 include a foam or silicon tip that is pliable and compressible to be inserted inside the ear canal where it expands and creates a comfortable seal within the ear canal. Custom in-ear monitors are constructed to substantially duplicate the exterior structure of an individual's ear. Accordingly, custom in-ear monitors increase the device's ability to isolate the ear canal from outside/ambient sounds. Individuals using custom in-ear monitors routinely seek sounds regarding their environment. The reaction of the audience to a particular song or lyric can influence how the performer interacts with the crowd to provide a better presentation.

Figure 4A:
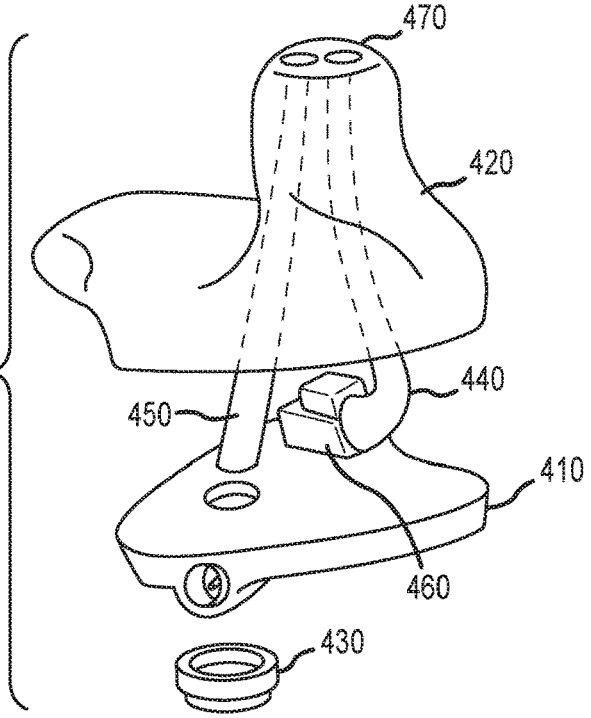
FIGS. 4A-C present alternative embodiments of a custom passive ambient in-ear monitor according to various embodiments of the present invention.
Figure 4B:
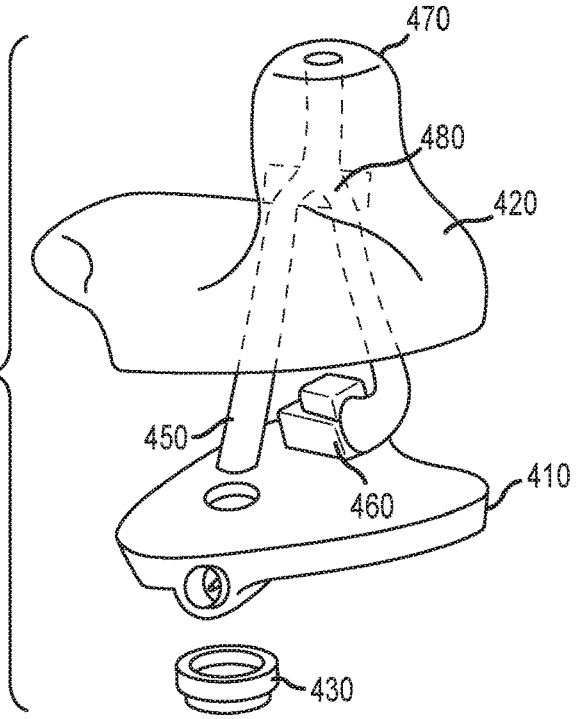
Figure 4C:
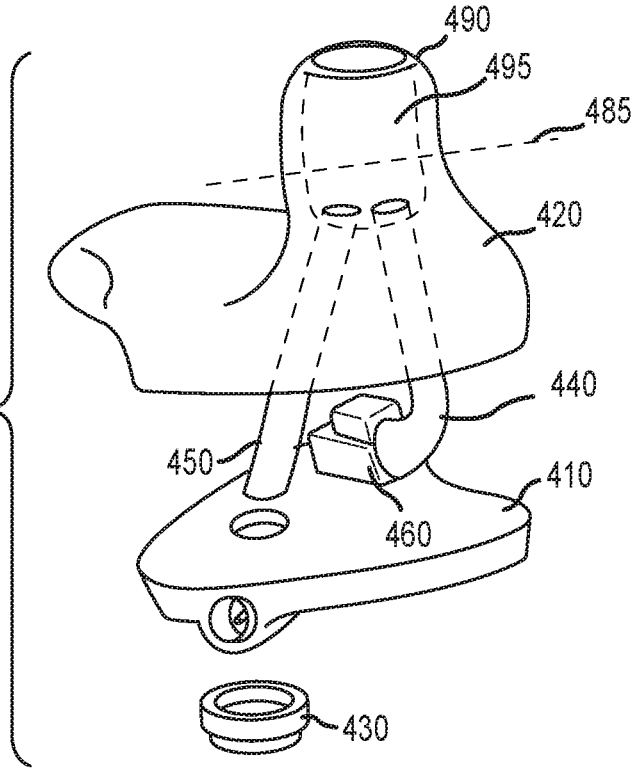
Figure 5A:
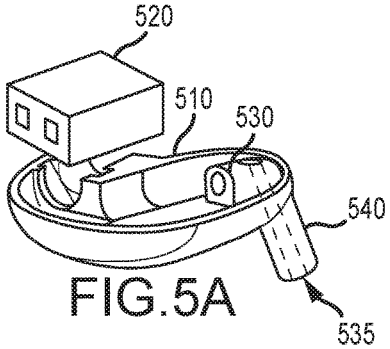
FIGS. 5A-H present a perspective graphical view of one assembly process for a single driver passive ambient in-ear monitor according to one embodiment of the present invention.
Figure 5E:
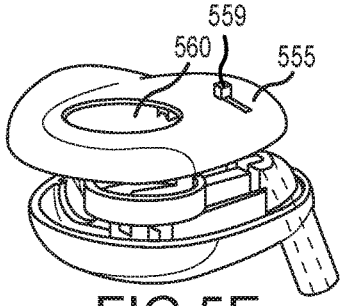
Figure 5B:
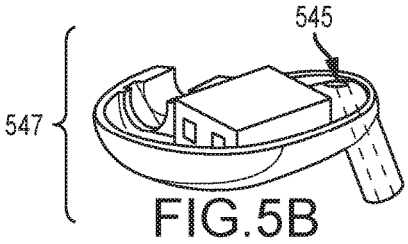
Figure 5F:
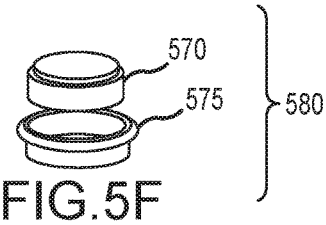
Figure 5C:
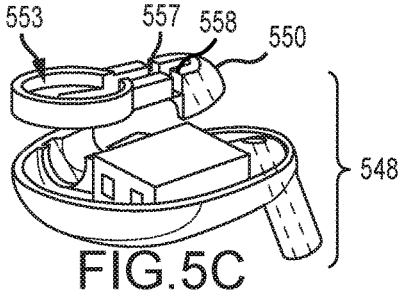
Figure 5G:
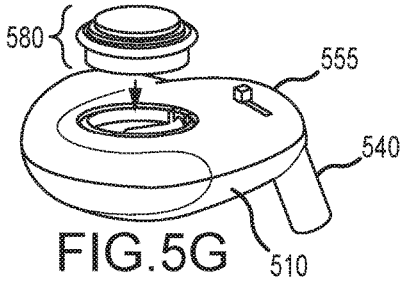
Figure 5D:
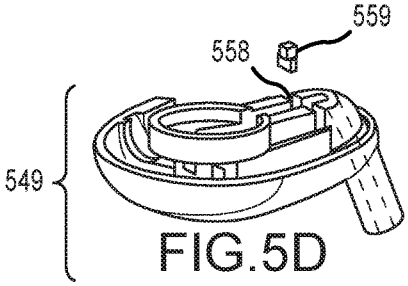
Figure 5H:
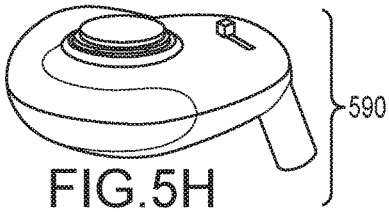
Figure 6A:
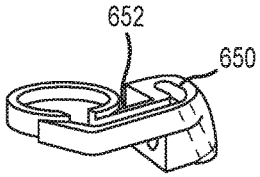
FIGS. 6A-H illustrates an embodiment of the present invention, presenting a perspective graphical view of an assembly process for a multiple-driver passive ambient in-ear monitor, according to one embodiment of the present invention.
Figure 6E:
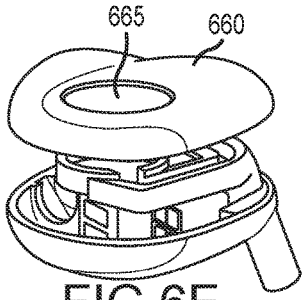
Figure 6B:
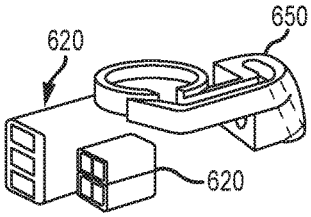
Figure 6F:
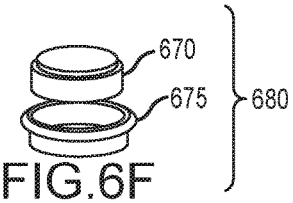
Figure 6C:
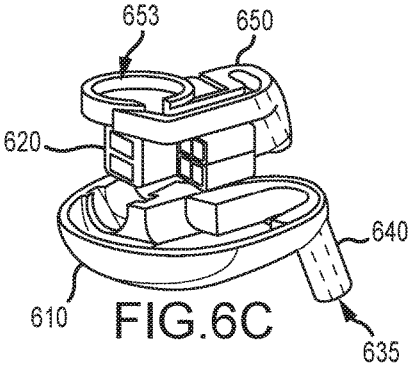
Figure 6G:
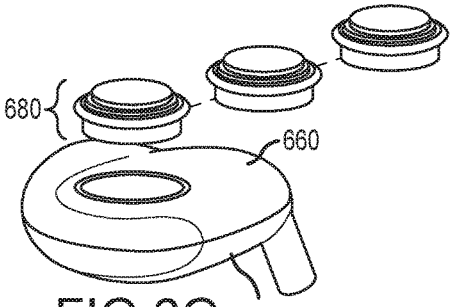
Figure 6D:
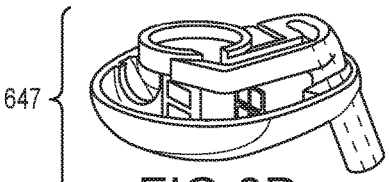
Figure 6H:
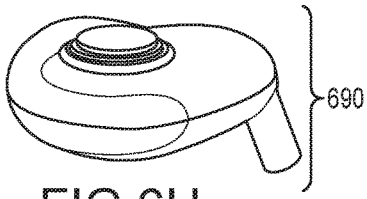
Figure 7A:
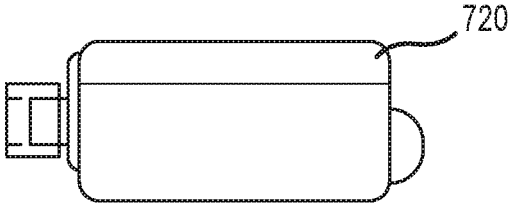
FIGS. 7A-7I show several side view renditions of a passive ambient in-ear monitor during assembly of the present invention.
Figure 7B:
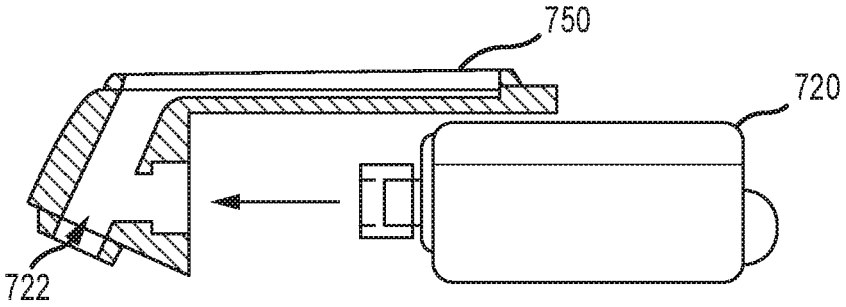
Figure 7C:
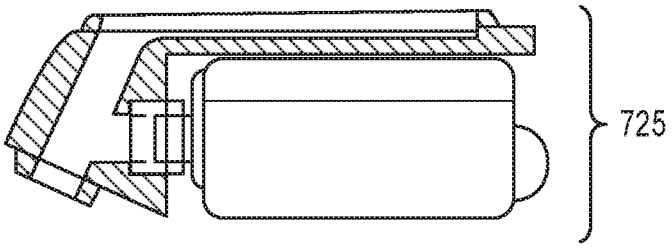
Figure 7D:
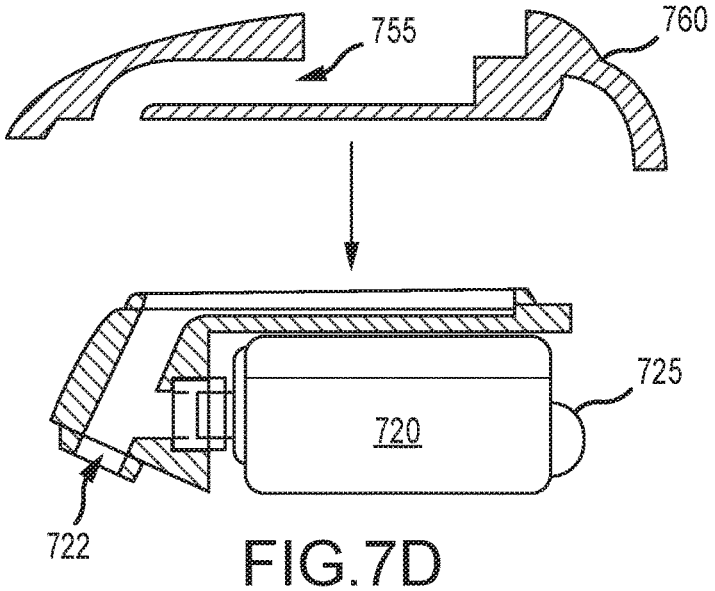
Figure 7E:
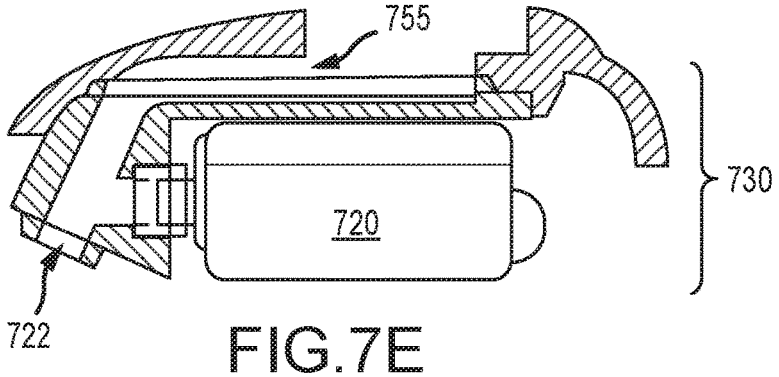
Figure 7F:
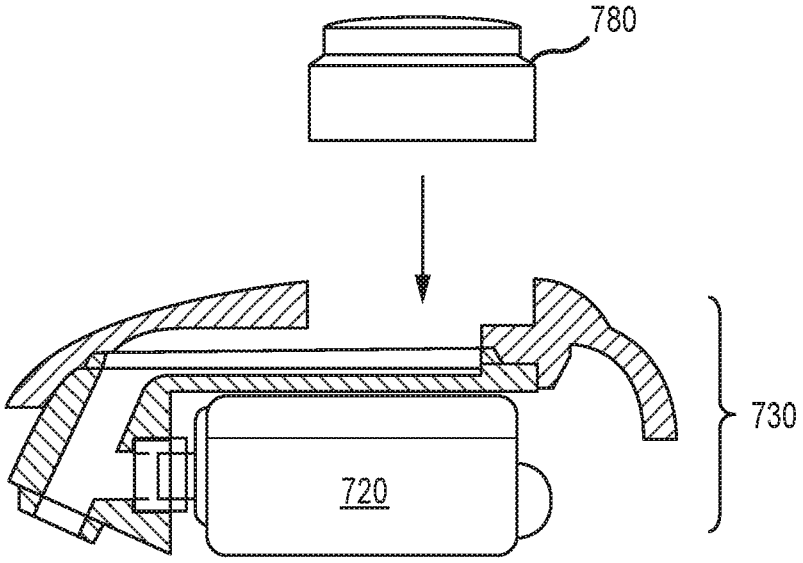
Figure 7G:
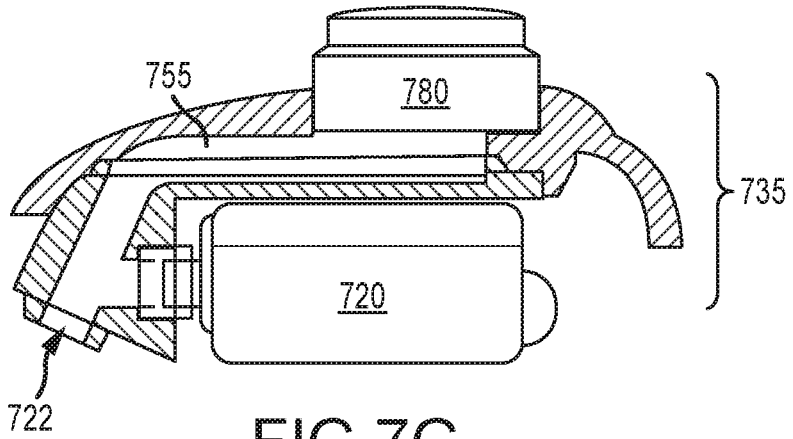
Figure 7H:
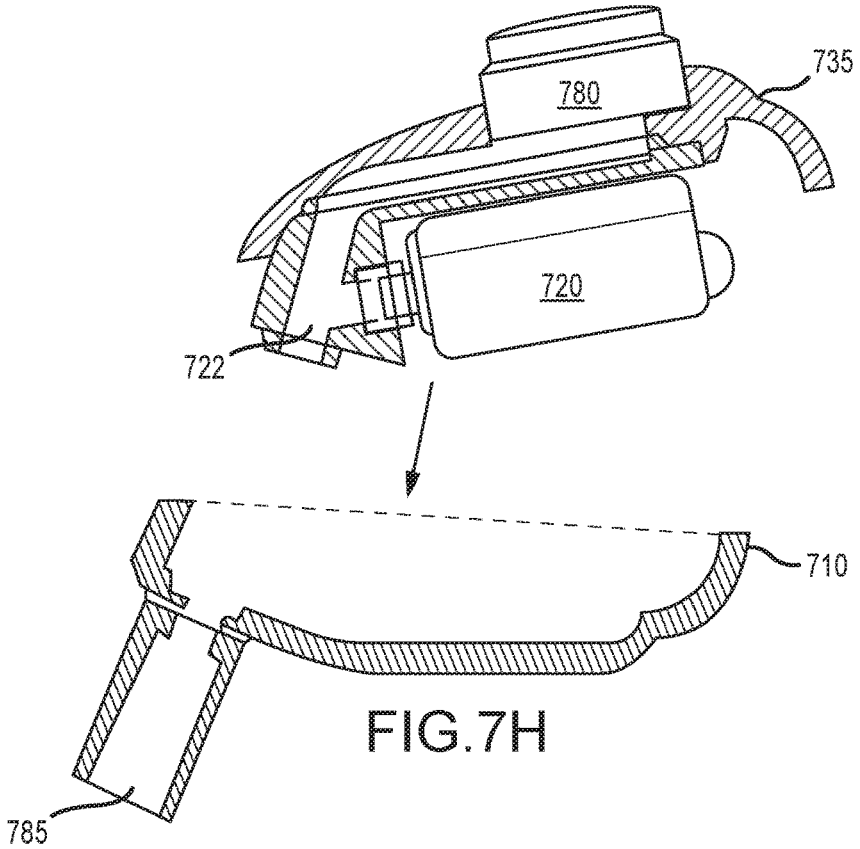
Figure 7I:
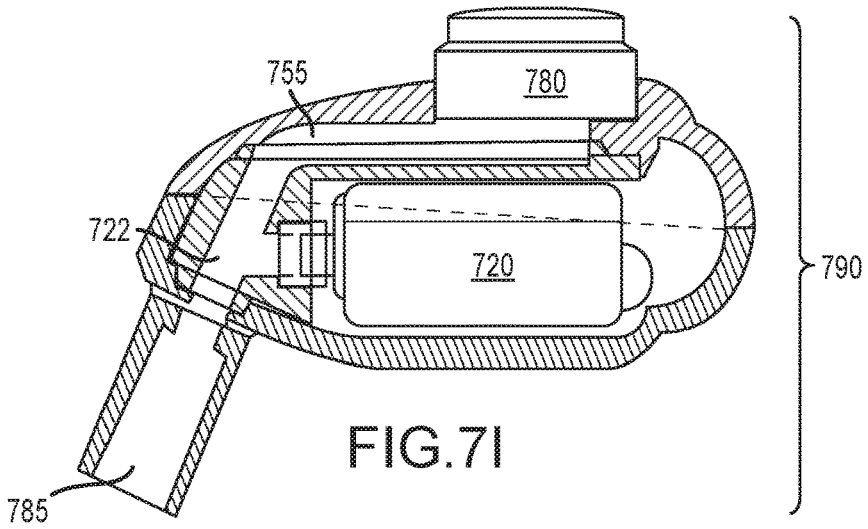

FIGS. 4A-4C present alternative embodiments of a custom passive ambient in-ear monitor according to one embodiment of the present invention. Turning to FIG. 4A, a custom in-ear monitor includes a faceplate 410 that is joined with an adaptive shell 420. The adaptive shell reflects the anatomical structure of the exterior portions of the ear and outer portions of the ear canal. Within the interior of the in-ear monitor exists one or more drivers 460 for generating internal sound waves. An internal sound channel 440 is coupled, in this embodiment to the drivers and directed to the portion 470 of the adaptive shell that resides within the ear canal.

The in-ear monitor of FIG. 4A further includes a unidirectional sonic filter 430 affixed to the exterior of the faceplate 410. The filter 430 is configured so as to permit attenuated ambient sound traversing from the outer face of the filter to the inner face of the filter and into the interior of the custom in-ear monitor. The attenuation of ambient sounds varies based on the needs of the user. In one embodiment, the filter may attenuate ambient sounds between 0-10 dB while in another embodiment the filter may attenuate ambient sound by 10-25 dB or by even 25-50 dB. One skilled in the relevant art will appreciate that the filter 430 associated with the passive ambient in-ear monitor of the present invention, may be modified based on user preferences. Filters are available in a range of fixed attenuation levels for different exposure levels, ensuring that the correct level of noise is reduced. Moreover, filters are designed in differing attenuation levels with linear or non-linear attenuation.

The inner face of the filter is, in the embodiment shown in FIG. 4A, coupled to an ambient vent tube 450. The ambient vent tube traverses the adaptive shell 420 of the custom in-ear monitor to deliver the attenuated ambient sound to the portion 470 of the shell resident within the ear canal. In this embodiment, the termination of the ambient vent tube 450 and the internal sound channel 440 coexist at the end 470 of the custom in-ear monitor within the ear canal.

FIG. 4B represents another embodiment of a custom passive ambient in-ear monitor. The embodiment presented in FIG. 4A and in FIG. 4B both provide a custom adaptive shell 420 that conforms to the anatomical exterior structure of a user's ear to present to the ear canal sound waves generated by the one or more drivers 460 contained within the in-ear monitor as well as ambient sounds from the surrounding environment.

As with the prior embodiment, a unidirectional sonic filter 430 allows ambient sound to traverse the filter from the outer face to the inner face. Once through the filter the ambient sounds are directed to the ear canal via an ambient vent tube 450. Similarly, sound waves generated by each of the one or more drivers 460 are directed to the ear canal by one or more internal sound channels 440. One skilled in the relevant art will appreciate that the sound channels may be implemented using flexible tubes. And while the invention has been particularly shown and described with reference to embodiments, it will be understood by those skilled in the art that various other changes in the form and details may be made without departing from the spirit and scope of the invention.

Unlike the embodiment shown in FIG. 4A, the embodiment presented in FIG. 4B includes a SLED 480 that acts to combine the ambient sounds waves with the internal sound waves. The combined sound waves are thereafter delivered to the terminal end 470 of the in-ear monitor located within the ear canal.

FIG. 4C presents an alternative embodiment of a custom passive ambient in-ear monitor having a deep open bore. A deep open bore 495 is a modification to the earpiece ear canal portion of the system to make a custom earpiece canal compliant and pliable so that it moves in conjunction with ear canal movement and deformations. Once inserted, the distal portion of the ear piece 490 easily compresses and expands with mandibular action of the wearer much like the universal-fit earpieces having a foam tip, as illustrated in FIGS. 2 and 3. This large or deep bore 495 allows the custom-fit canal tip on the custom earpiece to act more like a foam tip on the universal-fit product, and is yet configured to preserve the fidelity of the sound being conveyed by the driver(s) 460 and the ambient sound channel 450. Empirical evidence suggests equalization of air pressure from the environment outside of the ear to the inner the ear canal blocked by the earpiece can cause the filter 430 of the passive ambient in-ear monitor to pop or move causing a click or a thump (low frequency sound) that is heard by the wearer. Upon insertion of the ear piece into the ear canal a pressure differential may, and is likely to, form between the inner ear canal and the exterior environment. While the differential pressure may be minimal it can be sufficient to deform the filter membrane. During mandibular action the rigid nature of prior custom ear-pieces breaks and reestablishes a seal/pressure differential. During each cycle the membrane distorts and returns to its natural position creating a small popping or clicking sound. This phenomenon is not evident in the embodiments shown in FIGS. 2 and 3 wherein tip material, such as foam or silicone, is compliant and conforms to the shape of the ear during mandibular action. In those instances, the seal remains intact maintaining any differential pressure that may exist.

According to one embodiment of the present invention the distal portion (specifically the ear canal portion) of a custom passive ambient in-ear monitor 490 is comprised of a body temperature reactive material. The material is substantially ridged at room temperature but becomes pliable and compliant upon reaching body temperature or approximately 98 degrees Fahrenheit. The ability to be flexible and to adjust to the movement of the ear canal aids with the ear piece's ability to maintain a differential pressure. However, the use of a body reactive material alone is insufficient to maintain a pressure differential between the exterior of the ear piece and the inner canal. The solution, according to one embodiment of the present invention, is to modify the interior cavity of a custom passive ambient in-ear monitor, past the first bend of a user's ear canal, to possess a deep open bore 495.

By expanding the bore (referred to herein as a deep bore) of the distal end of the custom passive ambient in-ear monitor and by creating a thin walled canal structure 490, the interior portion of the earpiece, formed from body temperature reactive material, can match the mandibular motion/action of the inner ear canal. This thin walled structure maintains the seal during jaw movement as may be experienced during singing and stops or at the very least substantially minimizes any changes in pressure between the inner ear canal and the outside environment. With the differential pressure remaining substantially consistent, rapid movement of the filter membrane is reduced or eliminated. Accordingly the modifications arrest the attenuating membrane in the filter from causing a click/thump/pop sound.

To be effective the deep bore must extend beyond (outward) the first bend in the ear canal and be of sufficient depth to receive and convey sound from both the drivers and the ambient sound channel. FIG. 4C presents a custom passive ambient in-ear monitor in which a sound channel 440 from one or more drivers 460 and an ambient vent 450 separately terminate within a deep bore cavity 495 at the distal end of the in-ear monitor. While each individual's ear canal is unique, all ear canals possess a serpentine or "S" shape that conveys sound from the exterior to the ear drum. A custom ear piece must extend beyond the first bend in the ear canal to secure it, position it and ensure the user receives consistent and quality sound production by the drivers. The deep bore 495, according to one embodiment of the present invention traverses a line 485 identifying the first bend of an individual's ear canal. This line is identified by an inflection of slope representing the serpentine nature of the ear canal.

The thin wall nature of the distal end of the ear piece is both elastic and rigid at room temperature but pliable and compliant at body temperature. The distal end of the ear piece is elastic, meaning upon removal and cooling to room temperature it will revert to its custom shape for subsequent insertion into the ear canal. As shown in FIG. 4C the depth of the bore is sufficient to extend beyond the first bend of the ear canal so that it is retained by the user despite mandibular motion.

In other embodiments of a custom passive ambient in-ear monitor the ambient vent and the internal sound channel from the drivers are combined to form a single common sound channel that thereafter terminates in the proximal end of the in-ear monitor.

The present invention combines, an in-ear monitor, sound waves produced by high fidelity drivers with ambient sound from the nearby environment. The introduction of the ambient sound by way of a unidirectional sonic filter enables the in-ear monitor to provide minimal frequency response degradation throughout the listening frequency spectrum. Specifically, low frequencies are maintained despite the introduction of a source of ambient sound.

To illustrate the novelty of the present invention, consider the use of in-ear monitors in a musical performance setting. Performers often complain that in-ear monitors isolate them from the audience. During a performance musicians and performers alike thrive off feedback they receive from the audience. Yet in-ear monitors that provide several advantages to the legacy wedge monitors positioned on the stage fail to produce such feedback. Each in-ear monitor can be individually tuned to provide each member of the group a unique mix of the sound to enhance their individual experience. A bass player may for example wish to hear their track emphasized over the lead guitar even though the audience would hear a balanced combination of both. Traditional in-ear monitors provide such advantages with the cost of isolation from the environment.

A well-known solution in the prior art is to include an ambient vent in the monitor so that the piped in sound via the drivers within the in-ear monitor can be combined with ambient sound. But by doing so frequency response for the internally produced sound is degraded. This is especially true with respect to the low frequency range.

The present invention enables each player in a musical group to experience ambient sound without sacrificing the quality of the sound produced by the in-ear monitor across the entirety of the frequency spectrum. The ambient vent is constrained using a unidirectional sonic filter. The filter and the SLED allows attenuated sound to enter the in-ear monitor but substantially reduces any sounds from exiting the in-ear monitor. For example, the attenuation of sound traversing the filter from the outer face to the inner face may be 10 dB while the attenuation of sound traversing the filter from the inner face to the outer face is considerably higher. The result is a substantially closed environment the equivalent of the traditional in-ear monitor. Frequency response throughout the entirety of the listening spectrum is maintained yet with the inclusion of ambient sounds.

Turning back to the example of the musical performers, each member can receive immediate feedback from the audience yet continue to receive a full spectrum of sounds from the monitor. A better illustration of an application of the present invention may be a religious service in which musicians are charged with not only supporting the choir but the congregation as well. The sound produced by the choir and the remaining musicians are each supplied to the musician via microphones or other inputs, but there are no forms of sound inputs from the congregation. With the ambient filter and SLED of the present invention the congregation is an integral part of the experience.

The present invention enables musicians and performers alike to receive ambient sounds while maintaining the fidelity of the music produced by the drivers within a fully occluded in-ear monitor. FIGS. 5A-H present a graphical view of an assembly process for a single driver passive ambient in-ear monitor according to one embodiment of the present invention. FIG. 5 presents eight separate stages of assembly however one skilled in the relevant art will appreciate these stages are merely snapshots of an extensive production and assembly process. Moreover, other assembly processes and designs consistent with the invention described herein are contemplated and within the scope of the claimed invention.

Image A of FIG. 5 shows in an exploded fashion the bottom half of an in-ear monitor housing 510 with the ear canal stalk 540 extending down and to the right and a single driver 520 with two electronic points of contact. The sound port (not shown) of the single driver 520 mates to an internal sound channel 530 that is molded into the lower portion of the housing 510. Image B presents the driver positioned within the lower half of the housing. Note the presence of a receptacle port 545 in the internal channel of the lower housing unit configured to receive the ambient sound channel found in the SLED.

Image C of FIG. 5 shows a SLED 550 according to one embodiment of the present invention. The SLED 550 presents a circular opening 553 with an elongated half channel portion of the ambient sound channel 557. The upper portion of the housing 555 mates with the SLED 550 to form the ambient sound channel between the inner face of the filter and the juncture with the internal sound channel 535. Image D shows the SLED mated with the driver and lower portion of the housing. Included in the SLED 550, and traversing the ambient sound channel 557 is a groove 558 in which can be placed a barrier 559 that would selectively block the ambient sound channel 557. In the embodiment shown in FIG. 5 the barrier 559 can be accessed and controlled through the outside surface of the upper housing 555. Moving the barrier 559 to traverse the ambient sound channel 557 occludes any ambient sound converting the passive ambient in-ear monitor to, effectively, a fully occluded in-ear monitor. As will be appreciated by one of reasonable skill in the relevant art, other configurations and implementations are contemplated that can selectively shut off the sound path from the sonic filter 570 to the internal sound channel 535.

The upper housing 555, shown in image E is placed on top of the SLED 550 and mates with the lower portion of the housing 510. While not shown, the interior of the upper portion of the housing 555 mates with the upper portion of the SLED 550 to complete the formation of the ambient sound channel 557. The mating of the upper housing to the upper portion of the SLED 550 further forms the groove 558 in which the barrier 559 can be selectively placed across the ambient sound channel. A circular hole 560 in the upper portion of the housing 555 is configured to accept the unidirectional filter 570 assembly shown in image F. A unidirectional sonic filter 570 possessing a predetermined degree of attenuation is fitted with a seal 575 and positioned with the circular receptacle 560 (hole) in the upper portion of the housing. As can be seen in image G the circular portion 553 of the SLED 550 protrudes through the upper portion of the housing 560 so as to receive the lower face of the filter assembly 580. The mating of the housing 555 and the filter assembly 580 form one embodiment of a passive ambient in-ear monitor 590 shown in image H.

FIGS. 6A-H illustrate an embodiment of the present invention, presenting another graphical view of an assembly process, here for a multiple-driver passive ambient in-ear monitor. Like FIG. 5, FIG. 6 also presents eight separate stages of assembly and again, one skilled in the relevant art will appreciate these stages as merely snapshots of an extensive production and assembly process. Moreover, other assembly processes and designs consistent with the invention described herein are contemplated and within the scope of the claimed invention.

Image A of FIG. 6 shows in an exploded fashion the a "dual-purpose boot" 650 (another embodiment of the SLED), here presenting a noticeably longer ambient sound channel 652 (bottom-half portion shown), tuned for a different frequency response from that in FIG. 5. As a result of the multiple-driver 620 ("multi-driver") configuration in this embodiment, the SLED 650 has a total of three sound input paths in this presentation: one from the ambient sound channel 652 and two from ports which mate to the multi-driver 620. A portion of one of the multi-driver input ports is shown in the figure, with the view of the other port for the larger portion of the multi-driver package obstructed by the lower ambient sound channel of the SLED. That is, unlike FIG. 5, the sound ports (not shown) of the multi-driver mate directly to these two input ports on the SLED 650, and of course the number and size of these ports can vary according to the desired frequency response. Image C presents the drivers 650 positioned within the lower half of the housing 610. Note the presence of a receptacle port in the internal channel of the lower housing unit configured to receive the ambient sound channel found in the SLED.

The SLED 650 again presents a circular opening 653 with an elongated half channel 652. The upper portion of the housing 660 mates with the SLED 650 to form the ambient sound channel between the inner face of the filter and the juncture with the internal sound channel. Image D shows the SLED 650 mated with the driver 620 and lower portion of the housing 610.

The upper housing 660, shown in image E is placed on top of the SLED 650 and mates with the lower portion of the housing 610. While not shown, the interior of the upper portion of the housing mate with the upper portion of the SLED to complete the formation of the ambient sound channel. A selective barrier to the ambient sound channel, described and shown with in FIG. 5, is also not shown but is compatible with the design of FIG. 6 and is a contemplated embodiment. A circular hole 665 in the upper portion of the housing 660 is configured to accept the unidirectional filter assembly 680 shown in image F. A unidirectional sonic filter 670 is fitted with a seal 675 and positioned through the circular receptacle 665 (hole) in the upper portion of the housing. As can be seen in image G the circular portion 653 of the SLED 650 protrudes through the upper portion of the housing 660 so as to receive the lower face of the filter assembly 680. The mating of the housing and the filter assembly form one embodiment of a passive ambient in-ear monitor 690 shown in image H.

In one embodiment of the present invention, the filter assembly 680, comprised of the unidirectional sonic filter 675 and a seal 675, are fashioned to be interchangeable with the circular receptacle 665 of the upper housing 660. One of a plurality of filter assemblies 680 can be inserted into the circular receptacle based on the needs of the user and environment. Each filter assembly 680 can have differing levels of attenuation. On a quiet stage a musical performer using the passive ambient in-ear monitor of the present invention can configure the in-ear monitor to have a low strength sonic filter that allows more ambient sound into the sound channel. In other circumstances a user may wish to diminish the amount of ambient sound and choose a sonic filter with more attenuation. For example, filter assemblies 680 can be configured to have attenuation values of 10 dB, 16 dB, 20 dB, 25 dB and even a solid plug that completely occludes passive sound. By possessing multiple filter assemblies 680 a user can configure the passive ambient in-ear monitor to accommodate the environment and personal preferences.

Another illustrative embodiment of the passive ambient in-ear monitor of the present invention is shown in FIGS. 7A-7I. While FIGS. 5 and 6 present perspective views of various components of a passive ambient in-ear monitor, FIG. 7 illustrates a side point of view. Image A of FIG. 7 is a sonic driver 720. While this embodiment demonstrates the mating of a single driver with an ambient sound channel, one of reasonable skill in the relevant art will recognize that one or more drivers can be used in the designs presented herein without departing from the scope of the invention. Indeed, the invention contemplates multiple implementations of passive ambient in-ear monitors that include differing combinations of filters and drivers depending on user demands.

Turning back to FIG. 7, the driver 720 of image A is joined with one embodiment of a SLED 750 to form a driver/SLED assembly 725 of image B. In this case the SLED 750 includes an internal sound channel 722 orientated with respect to the driver port so as to facilitate sound reflection toward the ear canal stalk. The upper portion of the housing 760 is thereafter joined with the driver/SLED assembly 725 forming ambient sound channel 755.

Image E presents a side view of combined assembly of the SLED 750, driver 720 and upper portion of the housing 760. This side view illustrates the receptacle for the unidirectional filter 780 and juncture of the ambient sound channel 755 and the internal sound channel 722. Note this embodiment fashions the filter receptacle within the upper housing rather than the SLED.

Images F and G illustrate the juncture of the unidirectional filter into the upper portion of the housing. This combined assembly 735 is thereafter positioned within the lower portion of the housing 710 so as to align the internal sound channel of the SLED with the ear canal stalk. Image I presents a side view of an assembled passive ambient in-ear monitor 790, according to one embodiment of the present invention, wherein a passive ambient sound channel mates with an internal sound channel to deliver to the ear canal stalk 785 sound waves generated by the speakers in the driver as well as ambient sounds of the environment.

Figure 8:
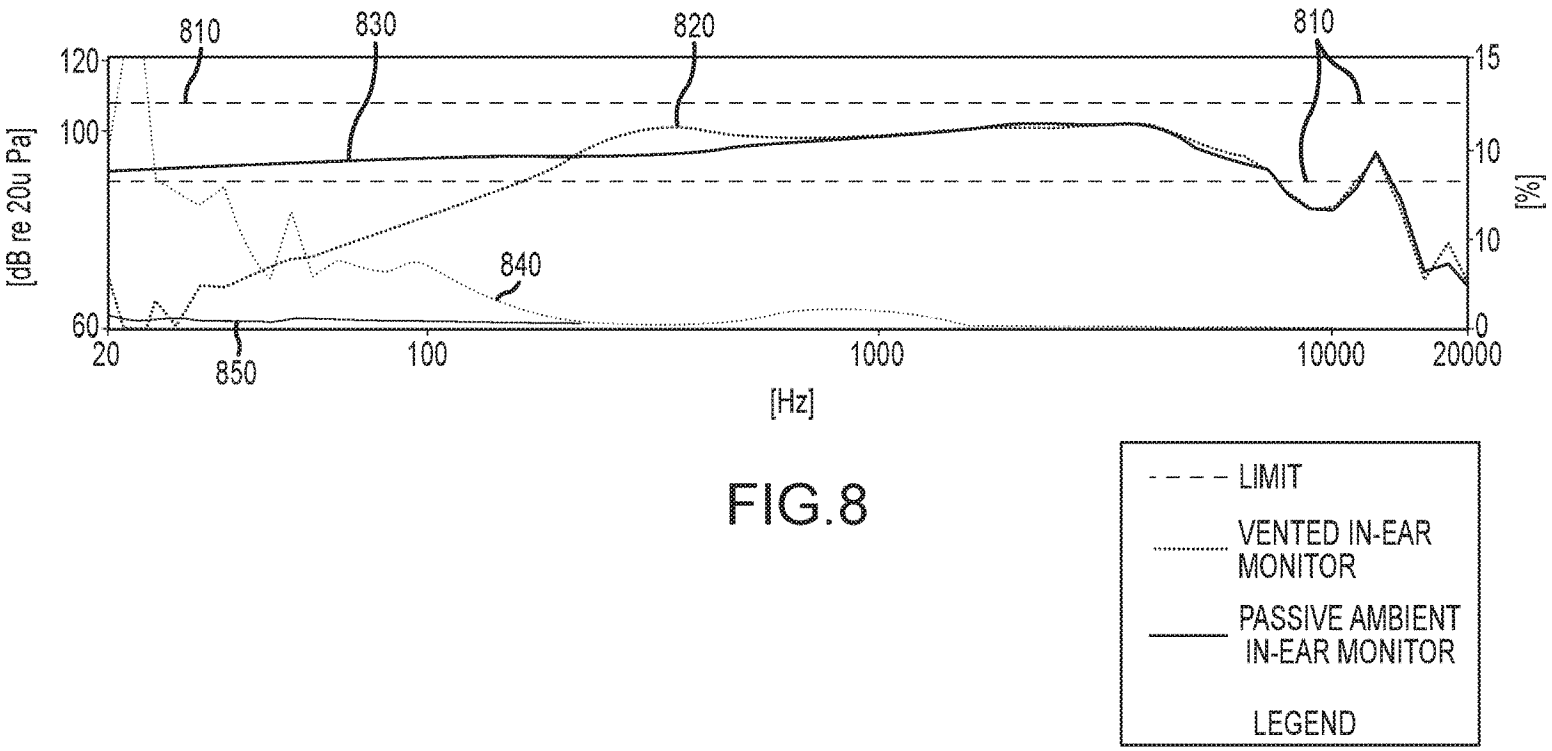
Figure 9:
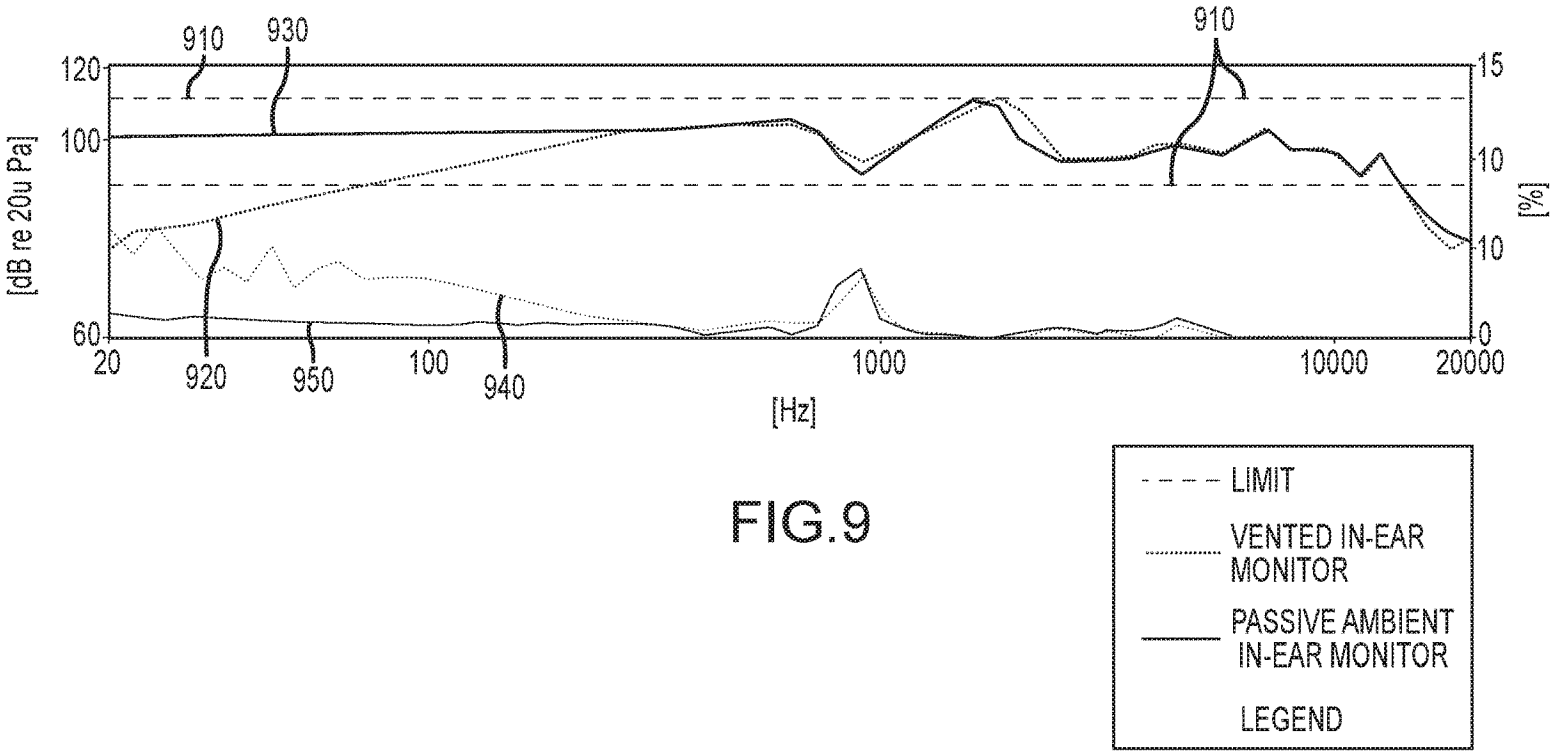

To illustrate the performance of the passive ambient in-ear monitor consider the following frequency test plots. FIG. 8 and FIG. 9 show plots of frequency response of a passive ambient in-ear monitor, according to one or more embodiments of the present invention, from approximately 20-20000 Hz. In each plot the frequency response of the sound produced by the driver and measured at the end of the ear canal stalk is presented along with any associated distortion. The plots show a comparison of the invention using various combinations of unidirectional sonic filters and spatial volumes.

The plots show the result of putting the device/design/invention to use and represent the results of a frequency response sweep, in this instance 20 Hz to 20000 Hz. Both the frequency response and distortion results are represented by solid and dotted lines respectively on the graph, while the performance limits and parameters of a fully occluding earpiece design is represented by the dashed "limit" lines. The dashed lines are the frequency response limits for a fully occluding in-ear monitor, the output in dB is represented by the numbers on the left side of the graph. The limit lines for distortion have been omitted for clarity however the percentage of distortion is read on the right side of the graph. The bold dotted lines are the result of testing of an earpiece that has a vent traveling through the earpiece from the outside surface to the ear canal, while the solid lines represent an earpiece using the principles of the invention. The bold solid lines are the frequency response of the in-ear monitors under test. As shown the monitors shown by the bold dotted line each have a significantly reduced (degraded) low frequency response output between 700 Hz and 20 Hz, while the bold solid line representing an earpiece built according to the invention maintains the low frequency response very close to the limit lines set for a fully occluding in-ear monitor. The corresponding solid (non-bold) lines, representing distortion, are well below the limit line set for a fully occluding in-ear monitor on the monitor using the design while the dotted (non-bold) line for the earpiece having a vent shows a distortion indicative of a condition in which the signal to noise ratio of the low frequency response is significantly impaired.

FIG. 8 presents a comparison of a passive ambient in-ear monitor using a unidirectional sonic filter with an ambient sound channel and an open-air vent (or a bidirectional sonic filter). The plot shows that the frequency response between the in-ear monitor having an open vent as compared to one with a unidirectional filter in accordance with the present invention are substantially the same from approximately 20000 Hz to 700 Hz. At frequencies below 700 Hz the plots begin to diverge. The frequency response of the ambient passive in-ear monitor 830 according to the present invention remains substantially flat from 700 Hz to 20 Hz while the frequency response for the in-ear monitor with an open vent 820 drops dramatically. The plot illustrates the negative effect of an open air, ambient, vent in the in-ear monitor with respect to the low frequency spectrum. Similarly, the distortion of the signal for the open ambient vents 840 increases to unacceptable levels below 700 Hz while the passive ambient in-ear monitor 850 of the present invention remains with acceptable levels.

FIG. 9 presents a comparison of a passive ambient triple driver in-ear monitor with a unidirectional filter and an ambient sound channel as compared to a passive ambient triple driver in-ear monitor with a unidirectional filter but lacking a dedicated ambient sound channel. FIGS. 2 and 3 represent similar designs of passive ambient in-ear monitors. As with the prior example, both designs show acceptable frequency response at frequencies greater than 700 Hz. However, as frequency drops the frequency response of each design begins to diverge. The passive ambient in-ear monitor utilizing an ambient sound channel 930 presents a flat frequency response while the design lacking the ambient sound channel 920 falls off commensurate with lower frequencies.

Spatial volume through which the internal sound waves travel is an important factor in the determination of frequency response. Recall, sound is a pressure wave vibration of molecules. Whenever you give molecules a "push" you're going to lose some energy to heat. Because of this, sound is lost to heating of the medium it is propagating through. The attenuation of sound waves is frequency dependent in most materials. Low frequencies are not absorbed as well as high frequencies. This means low frequencies will travel farther. Reflection is also frequency dependent. High frequencies are better reflected whereas low frequencies are able to pass through a barrier.

The pressure wave of low frequency sound is a longer wavelength than that of a high frequency wave. And while it can travel further it does so by pushing more molecules. In an open environment, it is more difficult to "push" those molecules than if it was in a constrained environment. Consider an exaggerated example. If the same volume of air is added to two containers of different sizes, the smaller container will experience a larger increase in pressure. The drivers by creating sound waves are creating pulses in pressure. If the ambient vent is open to the outside environment the volume of air is so large that the pressure changes of low frequency waves is lost. But if that space is constrained the pressure is maintained. An important aspect of the present invention is the recognition that management of the internal spatial volume of the sound channels is critical to achieve an acceptable frequency response. From the perspective of the internal drivers, the passive ambient in-ear monitor of the present invention is a closed system. The ear canal is fully occluded. The ear drum represents one barrier with the unidirectional filter the other. In a closed environment, the small drivers of low frequency sound waves produce a flat frequency response profile. But as shown in FIG. 8, once the system (in-ear monitor) is held open to the environment the ability of the low frequency drivers to maintain an adequate frequency response diminishes. The size of the drivers is constrained since the entirety of the device resides in the ear. One of reasonable skill in the art will recognize that over the ear head phones address this issue by increasing the size of the driver (speaker) to accommodate this low frequency drop off.

Even closing the in-ear monitor by using a unidirectional filter improves low frequency response as compared to an open vent. This is readily apparent by observing the differences in FIGS. 8 and 9. But adequate low frequency response can only be accomplished with precise management of the spatial volume of the sound channels. This includes the volume of the ambient sound channel as it is combined with the internal sound channel. For each driver combination, a predetermined spatial volume is identified that will provide a flat frequency response for the entirety of the frequency spectrum. As the filters are unidirectional, different levels of attenuation of ambient sound can be used without changing the design, however different driver and sound channel configuration require different ambient sound channel configurations so as to correlate the capability of the drivers with the constrained spatial volume.

Included in the description are flowcharts depicting examples of the methodology which may be used to provide ambient passive sound in an in-ear monitor. In the following description, it will be understood that each block of the flowchart, and combinations of blocks in the flowchart support combinations of means for performing the specified functions and combinations of steps for performing the specified functions. It will also be understood that each block of the flowchart illustrations, and combinations of blocks in the flowchart illustrations, can be implemented by special purpose hardware-based systems that perform the specified functions or steps, or combinations of special purpose hardware.?

Figure 10:
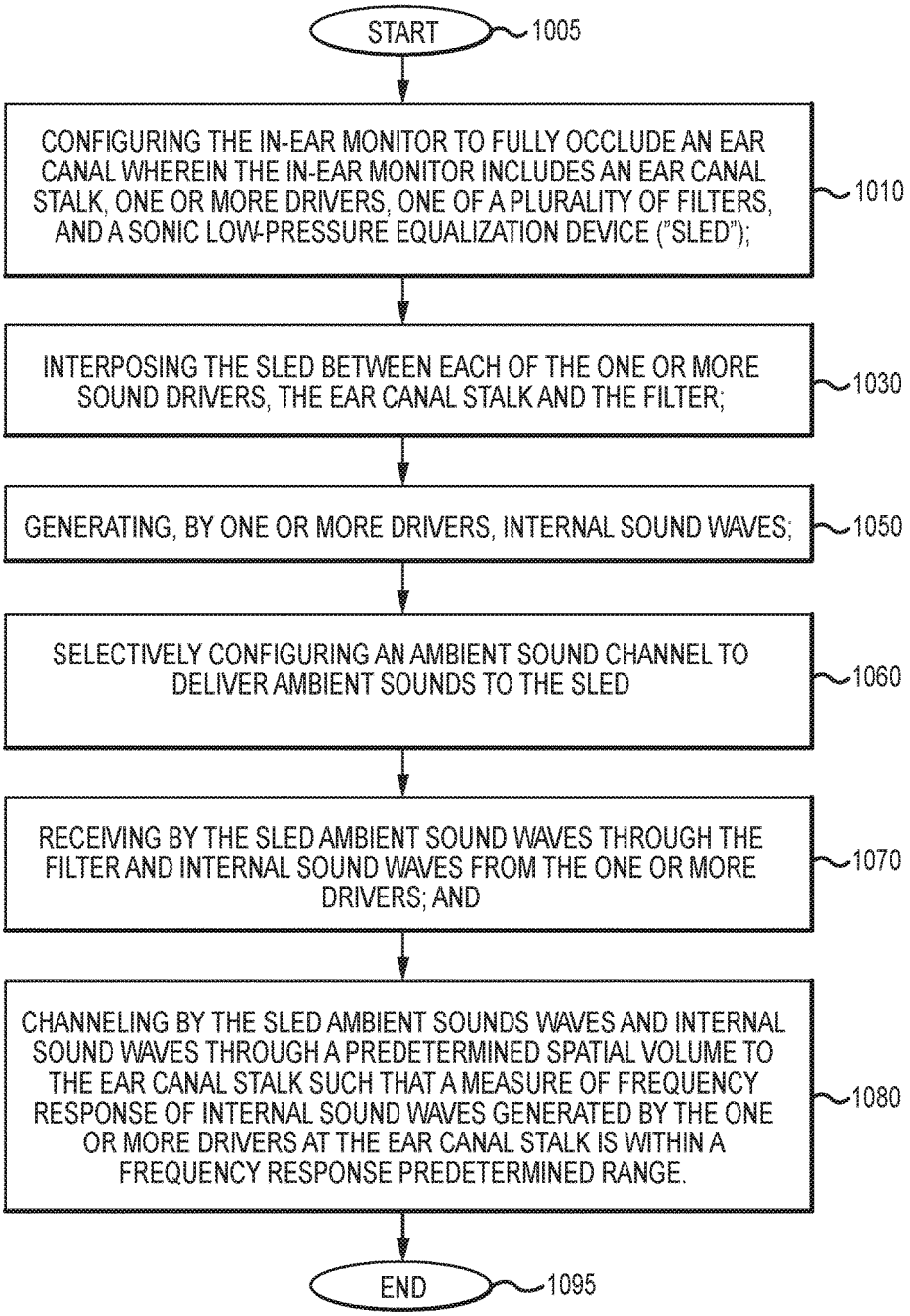
FIG. 10 is a flowchart showing one embodiment of methodology, according to the present invention, for providing passive ambient sound in an in-ear monitor.

FIG. 10 is a flowchart showing one embodiment of methodology, according to the present invention, for providing passive ambient sound in an in-ear monitor. The process begins 1005 with configuring 1010 an in-ear monitor to fully occlude an ear canal. As previously discussed and in accordance with one or more embodiments of the present invention, the in-ear monitor includes an ear canal stalk, one or more drivers, a filter and a Sonic Low-pressure Equalization Device ("SLED").

The SLED is interposed 1030 between each of the one or more sound drivers, the ear canal stalk (and ultimately the ear drum) and the filter to establish a closed system. Each of the one or more drivers generate 1050 internal sound waves that are delivered to ports in the SLED. The SLED also receives 1070 attenuated ambient sound waves through the unidirectional sonic filter.

The SLED then channels 1080 the ambient sounds waves and internal sound waves through a predetermined spatial volume to the ear canal stalk and ultimately 1095 to the ear drum such that a measure of frequency response of internal sound waves generated by the one or more drivers at the ear canal stalk is within a frequency response predetermined range.

The range of the frequency response is based on a combination of the drivers and the predetermined spatial volume. In one embodiment of the frequency response predetermined range of internal sound waves at the ear canal stalk for 20-20000 Hz is ±4 dB while in another embodiment frequency response predetermined range of internal sound waves at the ear canal stalk for 20-20000 Hz is ±6 dB. Other embodiments can focus on a reduced frequency range such as 20-200 Hz or other ranges as required by the implementation of the passive ambient in-ear monitor.

Similarly, the attenuation of ambient sound by the unidirectional filter can be set based on the implementation and can experience a linear or non-linear based frequency attenuation. While the examples presented herein have been focused on implementation of a passive ambient in-ear monitor as utilized in an entertainment or performance environment, the present invention can be equally applicable in an industrial environment. Even passengers on a subway can find the inclusion of ambient sounds at a diminished amplitude beneficial without sacrificing the quality of the sound they are hearing from the speakers in their earphones. Consider an individual who likes to listen to high fidelity music on the subway but would also like to be aware of the announcements of the upcoming stops.

Embodiments of the present invention enable the user to experience high fidelity sound with little to no frequency response degradation and the inclusion of ambient sound. The inclusion of ambient sound enhances the user's experience in many settings especially when it is done without sacrificing the quality of the reproduced sound.

Upon reading this disclosure, those of skill in the art will appreciate still additional alternative structural and functional designs for a system and a process for providing passive ambient sound in an in-ear monitor through the disclosed principles herein. Thus, while particular embodiments and applications have been illustrated and described, it is to be understood that the disclosed embodiments are not limited to the precise construction and components disclosed herein. Various modifications, changes and variations, which will be apparent to those skilled in the art, may be made in the arrangement, operation and details of the method and apparatus disclosed herein without departing from the spirit and scope of the present invention.

Particularly, it is recognized that the teachings of the foregoing disclosure will suggest other modifications to those persons skilled in the relevant art. Such modifications may involve other features that are already known per se and which may be used instead of or in addition to features already described herein. Although claims have been formulated in this application to particular combinations of features, it should be understood that the scope of the disclosure herein also includes any novel feature or any novel combination of features disclosed either explicitly or implicitly or any generalization or modification thereof which would be apparent to persons skilled in the relevant art, whether or not such relates to the same invention as presently claimed in any claim and whether or not it mitigates any or all of the same technical problems as confronted by the present invention. The Applicant hereby reserves the right to formulate new claims to such features and/or combinations of such features during the prosecution of the present application or of any further application derived there from.

The invention claimed is:

1. A passive ambient in-ear monitor, comprising:

a housing;

an ear canal stalk;

a filter, wherein the filter includes an outer face and an inner face and wherein ambient sound waves traverse the filter from the outer face to the inner face into an ambient sound channel;

one or more sound drivers, wherein the one or more sound drivers produce internal sound waves; and a Sonic Low-pressure Equalization Device ("SLED") wherein the SLED is coupled to each of the one or more sound drivers, the ear canal stalk and the ambient sound channel and wherein the SLED includes a predetermined spatial volume channeling internal sound waves and ambient sound waves to the ear canal stalk such that a measure of frequency response of the internal sound waves at the ear canal stalk is maintained within a frequency response predetermined range beginning at 20 Hz.

2. The passive ambient in-ear monitor of claim 1, wherein the ear canal stalk includes an ear tip and wherein the ear tip fully occludes the ear canal.

3. The passive ambient in-ear monitor of claim 1, wherein the filter is a unidirectional sonic filter.

4. The passive ambient in-ear monitor of claim 3, wherein the unidirectional sonic filter substantially reduces internal sound waves traversing from the inner face to the outer face.

5. The passive ambient in-ear monitor of claim 3, wherein the unidirectional sonic filter attenuates ambient sound waves traversing from the outer face to the inner face.

6. The passive ambient in-ear monitor of claim 5, wherein the ambient sound waves traverse the unidirectional sonic filter at a predetermined diminished amplitude.

7. The passive ambient in-ear monitor of claim 6, wherein the unidirectional sonic filter attenuates ambient sound from 0 to 10 dB.

8. The passive ambient in-ear monitor of claim 6, wherein the unidirectional sonic filter attenuates ambient sound from 10 to 25 dB.

9. The passive ambient in-ear monitor of claim 1, wherein a frequency response predetermined range is ±4 dB.

10. The passive ambient in-ear monitor of claim 1, wherein the predetermine spatial volume is based on a degree of attenuation of ambient sound waves.

11. The passive ambient in-ear monitor of claim 1, wherein the frequency response predetermined range of the internal sound waves at the ear canal stalk over 20-20000 Hz is ±4 dB.

12. The passive ambient in-ear monitor of claim 1, wherein the frequency response predetermined range of the internal sound waves at the ear canal stalk over 20-20000 Hz is ±6 dB.

13. The passive ambient in-ear monitor of claim 1, wherein the frequency response predetermined range of the internal sound waves at the ear canal stalk over 20-2000 Hz is ±4 dB.

14. The passive ambient in-ear monitor of claim 1, wherein the SLED is an integrated component of the ear canal stalk.

15. A method for providing passive ambient sound in an in-ear monitor, the method comprising:

configuring the in-ear monitor to fully occlude an ear canal wherein the in-ear monitor includes an ear canal stalk, one or more drivers, a filter and a Sonic Low-pressure Equalization Device ("SLED");

interposing the SLED between each of the one or more sound drivers, the ear canal stalk and the filter;

generating, by the one or more drivers, internal sound waves;

receiving, by the SLED, ambient sound waves through the filter and internal sound waves from the one or more sound drivers; and channeling, by the SLED, ambient sounds waves and internal sound waves through a predetermined spatial volume to the ear canal stalk such that a measure of frequency response of the internal sound waves generated by the one or more sound drivers at the ear canal stalk is maintained within a frequency response predetermined range beginning at 20 Hz.

16. The method for providing passive ambient sound in an in-ear monitor according to claim 15, further comprising substantially reducing internal sound waves traversing the filter.

17. The method for providing passive ambient sound in an in-ear monitor according to claim 15, further comprising attenuating ambient sound waves received through the filter.

18. The method for providing passive ambient sound in an in-ear monitor according to claim 17, wherein the filter attenuates ambient sound waves from 0-10 dB.

19. The method for providing passive ambient sound in an in-ear monitor according to claim 17, wherein the filter attenuates ambient sound waves from 10-25 dB.

20. The method for providing passive ambient sound in an in-ear monitor according to claim 15, further comprising limiting the frequency response predetermined range to ±4 dB.

21. The method for providing passive ambient sound in an in-ear monitor according to claim 15, further comprising limiting the frequency response predetermined range to ±6 dB.

22. The method for providing passive ambient sound in an in-ear monitor according to claim 15, further comprising limiting the frequency response predetermined range is based on the predetermined spatial volume.

23. The method for providing passive ambient sound in an in-ear monitor according to claim 15, further comprising limiting the frequency response predetermined range of internal sound waves at the ear canal stalk for 20-20000 Hz to ±4 dB.

24. The method for providing passive ambient sound in an in-ear monitor according to claim 23, further comprising limiting the frequency response predetermined range of internal sound waves at the ear canal stalk for 20-2000 Hz to ±4 dB.

25. The method for providing passive ambient sound in an in-ear monitor according to claim 24, further comprising limiting the frequency response predetermined range of internal sound waves at the ear canal stalk for 20-200 Hz to ±4 dB.

* * * * *